US006224000B1

(12) United States Patent
Wang

(10) Patent No.: US 6,224,000 B1
(45) Date of Patent: May 1, 2001

(54) SPRINKLER NOZZLE

(76) Inventor: Tzu-Meng Wang, No. 91, Kwo-Tai Rd., Chu-Nan Chen, Miao-Li Hsien (TW)

( * ) Notice: Subject to any disclaimer, the term of this patent is extended or adjusted under 35 U.S.C. 154(b) by 0 days.

(21) Appl. No.: 09/548,082

(22) Filed: Apr. 12, 2000

(51) Int. Cl.[7] ..... A62C 31/02

(52) U.S. Cl. ..... 239/394; 239/392; 239/390; 239/437; 239/447; 239/538

(58) Field of Search ..... 239/394, 392, 239/395, 390, 436, 437, 440, 525, 526, 444, 447, 548, 540, 538, 537, 446, 600

(56) References Cited

U.S. PATENT DOCUMENTS

| | | | | |
|---|---|---|---|---|
| 4,666,085 | * | 5/1987 | Liaw | 239/394 |
| 5,566,886 | * | 10/1996 | Wang | 239/394 |
| 5,598,978 | * | 2/1997 | Wang | 239/394 |
| 5,823,442 | * | 10/1998 | Guo | 239/394 |

* cited by examiner

*Primary Examiner*—David A. Scherbel
*Assistant Examiner*—Dinh Q. Nguyen
(74) *Attorney, Agent, or Firm*—Dorsey & Whitney LLP

(57) ABSTRACT

A sprinkler nozzle has a housing with an inlet discharge; a separator having multiple holes arranged in circle in the face, a central hole defined to correspond to a blind hole defined in a pole in the housing, a notch defined to have multiple ribs formed on the face defining the notch, a disk securely engaged with the separator and having multiple function holes defined to align with the corresponding holes of the separator, multiple orifices defined in the peripheral edge, an isolator securely added between the housing and the separator and having an inlet integrally formed and extending out to correspond to the inlet discharge of the housing, a sealing ring made of a resilient material and provided to correspond to the inlet, an outlet formed opposite to and in communication with the inlet and having an annular wall formed in the outlet, an O-ring received in the annular wall, at least one stop formed to correspond to each of the holes of the separator and having a recess defined to receive therein an O ring. With such an arrangement, the watertight engagement between the housing and the separator is improved.

4 Claims, 7 Drawing Sheets

SPRINKLER NOZZLE

BACKGROUND OF THE INVENTION

1. Field of the Invention

The present invention relates to a sprinkler, and more particularly to a sprinkler nozzle which has an isolator for enhancing the watertight engagement between a holder and a sprinkling nozzle.

2. Description of Related Art

With reference to FIGS. 5, 6, 7 and 8, a conventional sprinkler is shown and has a housing (1) for receiving water flow from the hose (not shown) and a control panel (2) threadingly engaged with the peripheral edge of the housing (1) and having multiple exits defined in the face.

The housing (1) has an inlet (not shown) defined to communicate with the water source and an inlet discharge (11).

The control panel (2) is composed of a separator (21) and a disk (22) securely engaged with the separator (21). The separator (21) has multiple holes (211) arranged in a circle on the face, a central hole (212) defined to correspond to a blind hole (121) defined in a pole (12) in the housing (1) and a notch (214) defined to have multiple ribs (213) formed on a face defining the notch (214). The disk (22) has multiple function holes (221) each defined to align with one of the holes (211) of the separator (21) and multiple orifices (222) defined in the edge. When such a sprinkler is assembled, the pole (12) extends into the central hole (212) for receiving a bolt (not shown ) in the blind hole (121) to connect the housing (1) and the control panel (2) to allow the control panel (2) to be rotatably mounted on the housing (1). Furthermore, an O ring (111) is received in the inlet discharge (11) to enhance the watertight engagement between the inlet discharge (11) and one of the holes (211) that the (11) aligns with. When the sprinkler is in use and the inlet discharge (11) aligns with one of the holes (211), the water from the water source will then eject from the function hole (221) aligning with the hole (211) that aligns with the inlet discharge (11). Because each of the function holes (221) is specially designed to have different ejection effects, such as mist, solid stream, shower, soaker, flat, center .etc., the user will have different water ejections for different purposes. Furthermore, when the inlet discharge (11) aligns with the notch (214), the water flow from the water source will flow back to the space between the housing (1) and the separator (21) so as to enable the water to flow into all the holes (211) to accomplish a so-called "soft water" effect when watering precious plants, as shown in FIG. 8.

This kind of sprinkler does have the ability to adjust the water ejection to various needs, however, when the control panel (2) rotates relative to the housing (1), the O ring (111) somehow is jammed between the housing (1) and the separator (21) such that the watertight engagement between the housing (1) and the control panel (2) is reduced.

To overcome the shortcomings, the present invention tends to provide an improved sprinkler to mitigate and obviate the aforementioned problems.

SUMMARY OF THE INVENTION

The main objective of the invention is to provide an improved sprinkler nozzle having an isolator mounted between the housing and the control panel to prevent the O ring from being jammed so as to enhance the watertight engagement between the housing and the control panel.

Another objective of the invention is to provide at least one stop on the isolator. The stop has an O ring received therein and aligns with one of the holes, such that the watertight engagement between the isolator and the control panel is secured.

Still, another objective of the invention is to provide a bushing, made of resilient material, between the inlet discharge of the housing and the inlet of the isolator, such that the water flow from the inlet of the housing is able to flow into the inlet of the isolator directly and entirely.

A further objective of the invention is to provide a separator having a notch defined therein and a slit defined to communicate with the notch to release the pressure applied to the separator so as to prolong the life of the sprinkler.

Other objects, advantages and novel features of the invention will become more apparent from the following detailed description when taken in conjunction with the accompanying drawings.

DETAILED DESCRIPTION OF PREFERRED EMBODIMENT

Figure 1:
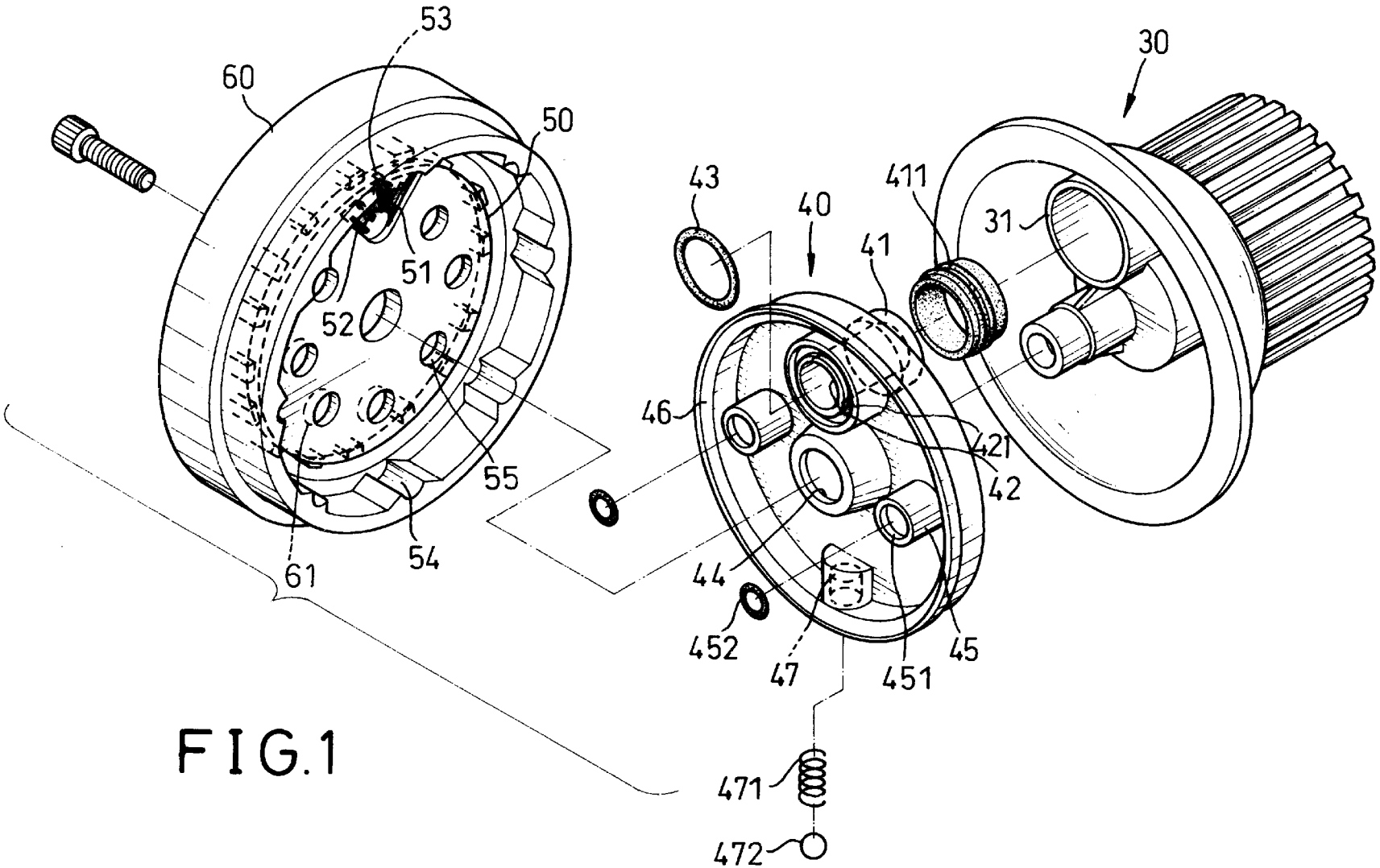
FIG. 1 is an exploded perspective view of the sprinkler nozzle in accordance with the present invention.

Referring to FIG. 1, a sprinkler nozzle in accordance with the present invention has a housing (30) with an inlet discharge (31), an isolator (40), a separator (50) and a disk (60).

The isolator (40) has an inlet (41), a seal ring (411), an outlet (42), an O ring (43), a central hole (44) and at least one stop (45). The inlet (41) is integrally formed with and extends out from the isolator (40). The seal ring (411) is made of a resilient material and corresponds to the inlet (41). The outlet (42) is formed opposite to and communicates with the inlet (41) and has an annular wall (421) formed in the outlet (42). The O ring (43) received in a groove formed between the annular wall (421) and the outlet (42). At least one stop (45) with a recess (451) is defined in the face of the isolator (40). The recess (451) receives an O ring (452). The isolator (40) further has a slanted peripheral edge (46) on the exterior wall (48) and a passage (47) defined to receive a spring (471) and ball (472) combination.

Figure 2:
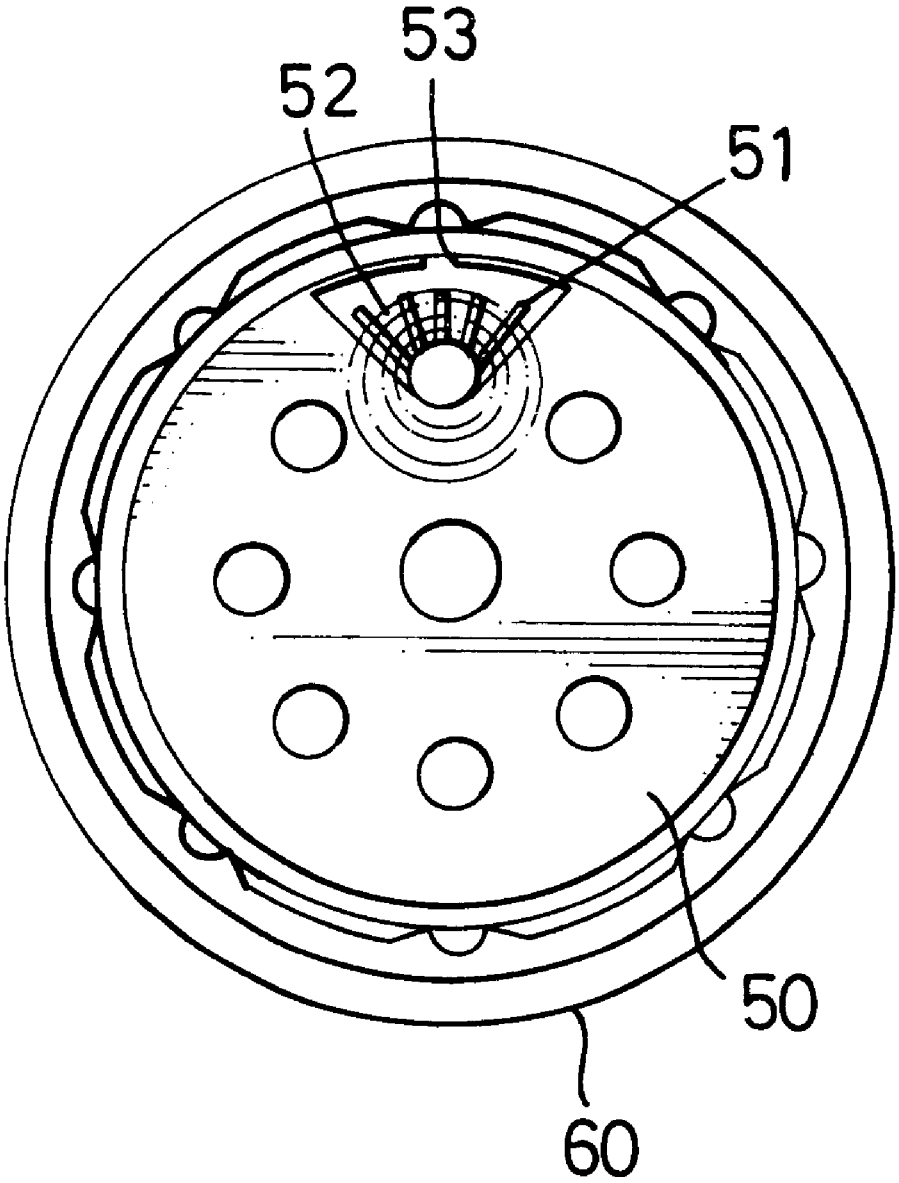
FIG. 2 is a rear plan view of the separator of the sprinkler nozzle in FIG. 1.
Figure 5:
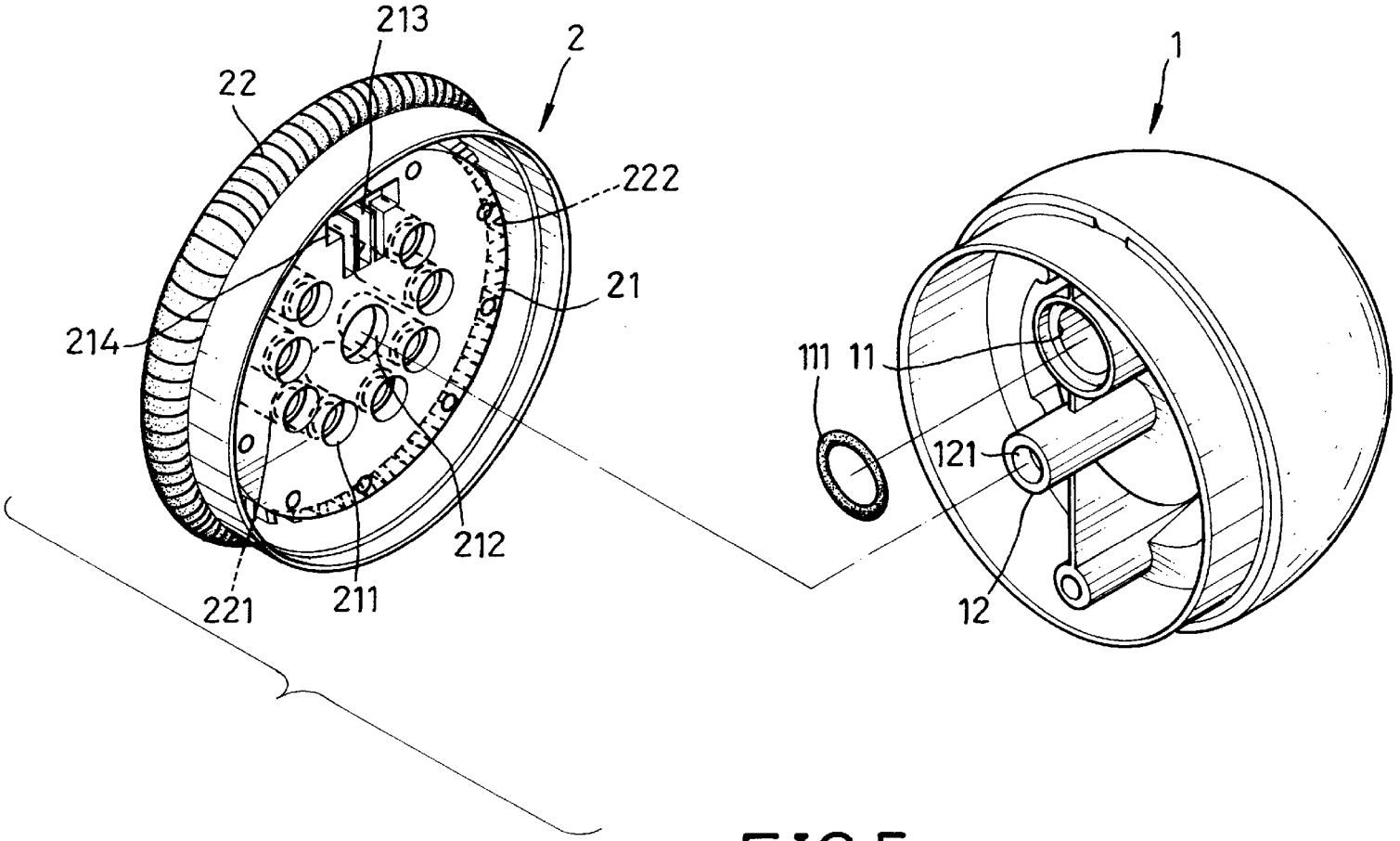
FIG.5 PRIOR ART
FIG. 5 is an exploded perspective view of a conventional sprinkler nozzle.
Figure 6:
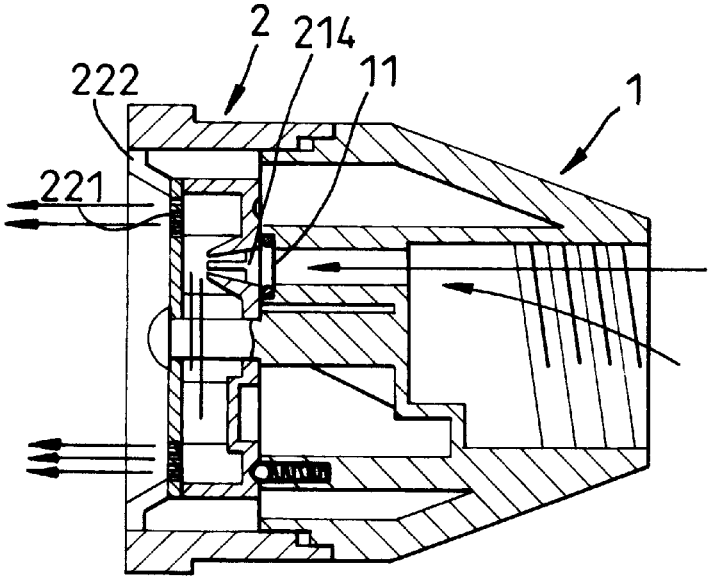
FIG.6 PRIOR ART
FIGS. 6, 7 and 8 are operational cross sectional side views of the sprinkler nozzle in FIG. 5.
Figure 8:
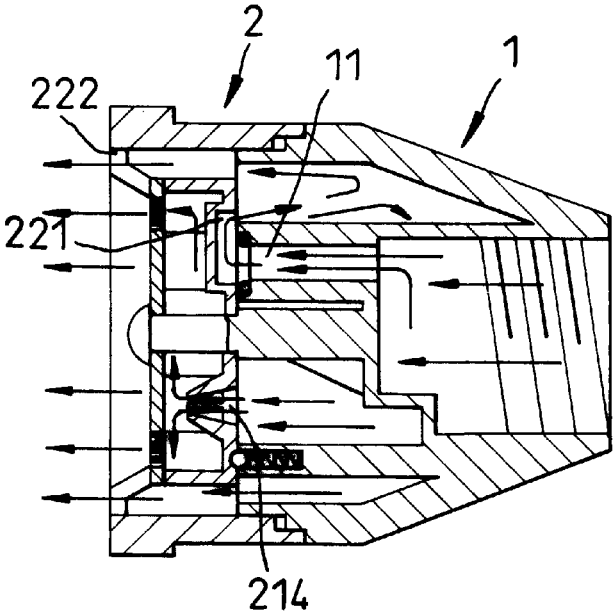
FIG.8 PRIOR ART
Figure 7:
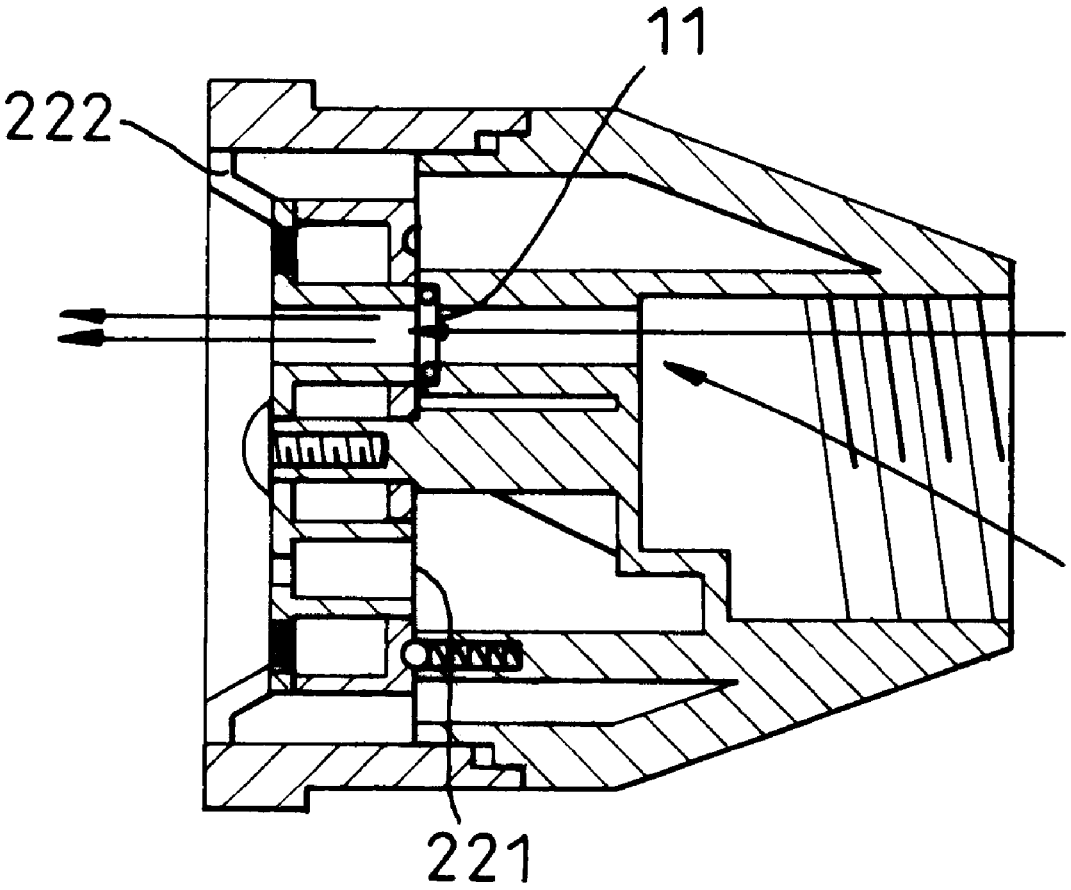
FIG.7 PRIOR ART

Basically, the structure of the separator (50) is fundamentally the same as the conventional separator in FIG. 5. However, the difference is in the notch (52) that has multiple ribs (51) and a slit (53) defined to communicate with the function holes (61) of the disk (60), as shown in FIG. 2. The separator (50) further has arcuate seats (54) formed on the inner face of the sidewall to correspond to the passages (47) in the isolator (40). When the separator (50) together with the disk (60) rotates relative to the isolator (40), the spring (471) and ball (472) combinations alternatively seat in the arcuate seats (54) to temporally hold the separator (50) and the disk (60) relative to the isolator (40).

Figure 3:
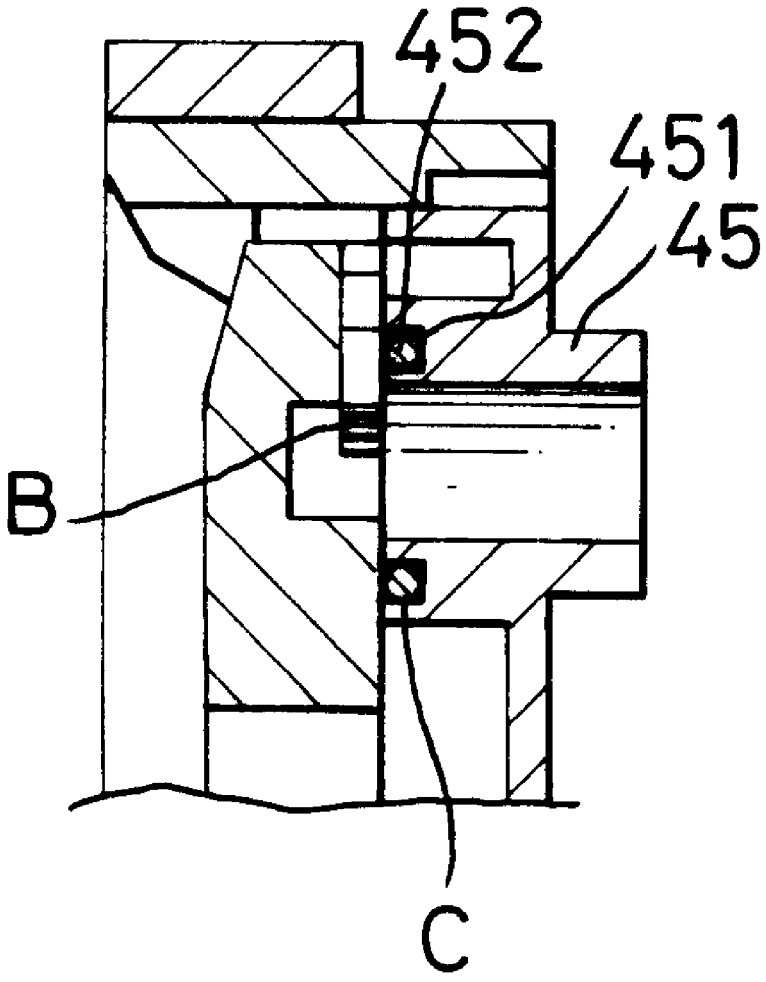
FIG. 3 a cross sectional side plan view of the engagement between the isolator and the separator in FIG. 1.
Figure 4:
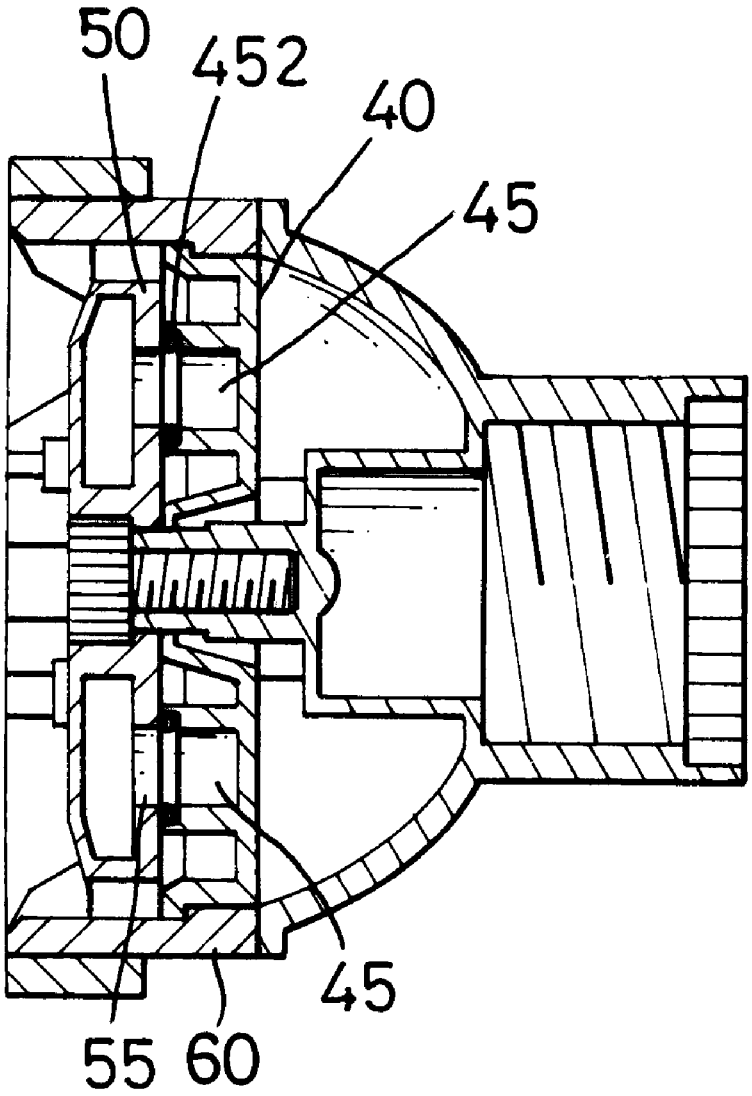
FIG. 4 is a cross sectional side plan view of the sprinkler nozzle in FIG. 1.

With reference to FIGS. 3 and 4, when the isolator (40) is assembled between the housing (30) and the separator (50), at least one stop (45) with an O ring (452) received in the recess (451) of the stop (45) aligns with one of the holes of the separator (50), which will increase the watertight engagement among the parts. When the outlet (42) aligns with one of the holes (55) of the separator (50), the water will flow into the hole (55) and be ejected out of the corresponding function hole (61) of the disk (60). However, the water somehow will still leak to other holes (55) of the separator (50). The alignment of the stops (45) with the other holes (55) in the separator (50) will reduce the leakage to a minimum.

It is to be noted that the present invention has the following advantages:

1. The addition of the isolator (40) increases the watertight engagement between the housing (30) and the separator (50) as well as the disk (60).
2. The O ring (452) received in the recess (451) defined in each stop (45) and the alignment of the stops (45) with the corresponding holes in the separator (50) reduce the leakage to a minimum.
3. The slit (53) in the notch (52) is able to reduce the water pressure applied to the separator (50) when the "soft water" effect is chosen, such that the life of the separator (50) is prolonged.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A sprinkler nozzle having a housing with an inlet discharge; a separator having multiple holes arranged in circle on a face thereof, a central hole defined to correspond to a blind hole defined in a pole in the housing, and a notch defined to have multiple ribs formed on a face defining the notch, and a disk securely engaged with the separator and having multiple function holes each defined to align with one of the holes of the separator and multiple orifices defined in the peripheral edge of the separator, wherein the improvements comprise:

an isolator is securely held between the housing and the separator and has an inlet integrally formed and extending out to correspond to the inlet discharge of the housing, a sealing ring made of a resilient material and provided to correspond to the inlet, an outlet formed opposite to and in communication with the inlet and having an annular wall formed in the outlet, an O-ring received in the annular wall, a central hole defined to correspond to the blind hole of the pole of the housing, at least one stop formed to correspond to one of the holes of the separator and having a recess defined to receive an O ring.

2. The sprinkler nozzle as claimed in claim 1, wherein the isolator further has a slanted peripheral edge and a passage radially defined in a wall to receive a spring and ball combination.

3. The sprinkler nozzle as claimed in claim 2, wherein the separator has multiple arcuate seats formed to alternatively correspond to the passage to temporarily hold the relative position of the separator to the housing.

4. The sprinkler nozzle as claimed in claim 1, wherein the separator has a slit defined in the notch to reduce the water pressure when the outlet of the isolator aligns with the notch.

* * * * *